US006470309B1

(12) United States Patent
McCree

(10) Patent No.: US 6,470,309 B1
(45) Date of Patent: Oct. 22, 2002

(54) SUBFRAME-BASED CORRELATION

(75) Inventor: Alan V. McCree, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/293,451

(22) Filed: Apr. 16, 1999

Related U.S. Application Data

(60) Provisional application No. 60/084,821, filed on May 8, 1998.

(51) Int. Cl.[7] ..... G10L 11/04
(52) U.S. Cl. ..... 704/207
(58) Field of Search ..... 704/207, 204, 704/219, 208

(56) References Cited

U.S. PATENT DOCUMENTS

| | | | | | |
|---|---|---|---|---|---|
| 5,179,594 | A | * | 1/1993 | Yip et al. | 704/217 |
| 5,253,269 | A | * | 10/1993 | Gerson et al. | 375/247 |
| 5,495,555 | A | * | 2/1996 | Swaminathan | 704/207 |
| 5,528,727 | A | * | 6/1996 | Wang | 704/208 |
| 5,596,676 | A | * | 1/1997 | Swaminathan et al. | 704/208 |
| 5,621,852 | A | * | 4/1997 | Lin | 704/219 |
| 5,710,863 | A | * | 1/1998 | Chen | 704/200.1 |
| 5,734,789 | A | * | 3/1998 | Swaminathan et al. | 704/206 |
| 5,778,334 | A | * | 7/1998 | Ozawa et al. | 704/214 |
| 5,799,271 | A | * | 8/1998 | Byun et al. | 704/207 |
| 5,924,061 | A | * | 7/1999 | Shoham | 704/203 |
| 6,014,622 | A | * | 1/2000 | Su et al. | 704/207 |
| 6,073,092 | A | * | 6/2000 | Kwon | 704/219 |
| 6,098,036 | A | * | 8/2000 | Zinser et al. | 704/206 |
| 6,148,282 | A | * | 11/2000 | Paksoy et al. | 704/208 |
| 6,151,571 | A | * | 11/2000 | Pertrushin | 704/207 |

FOREIGN PATENT DOCUMENTS

EP 0955627 A2 * 10/1999 ..... G10L/3/00

OTHER PUBLICATIONS

Kim, "Adaptive Encoding of Fixed Codebook in CELP Coders", 1998 IEEE, pp 149–152.*
Oshikiri et al, "A 2.4 kbps Variable bit rate adp–celp speech coder", pp 517–520, 6/98, IEEE.*
Ojala, "Toll Quality Variable Rate Speech Codec", pp 747–750, 1997 IEEE.*

* cited by examiner

*Primary Examiner*—Vijay Chawan
*Assistant Examiner*—Michael N. Opsasnick
(74) *Attorney, Agent, or Firm*—Robert L. Troike; Frederick J. Telecky, Jr.

(57) ABSTRACT

A subframe-based correlation method for pitch and voicing is provided by finding the pitch track through a speech frame that minimizes pitch prediction residual energy over the frame. The method scans the range of possible time lags T and computes for each subframe within a given range of T the maximum correlation value and further finds the set of subframe lags to maximize the correlation over all of possible pitch lags.

25 Claims, 4 Drawing Sheets

SUBFRAME-BASED CORRELATION

This application claims priority under 35 USC § 119(e) (1) of provisional application No. 60/084,821, filed May 8, 1998.

TECHNICAL FIELD OF THE INVENTION

This invention relates to method of correlating portions of an input signal such as used for pitch estimation and voicing.

BACKGROUND OF THE INVENTION

The problem of reliable estimation of pitch and voicing has been a critical issue in speech coding for many years. Pitch estimation is used, for example, in both Code-Excited Linear Predictive (CELP) coders and Mixed Excitation Linear Predictive (MELP) coders. The pitch is how fast the glottis is vibrating. The pitch period is the time period of the waveform and the number of these repeated variations over a time period. In the digital environment the analog signal is sampled producing the pitch period T samples. In the case of the MELP coder we use artificial pulses to produce synthesized speech and the pitch is determined to make the speech sound right. The CELP coder also uses the estimated pitch in the coder. The CELP quantizes the difference between the periods. In the MELP coder, there is a synthetic excitation signal that you use to make synthetic speech which is a mix of pulses for the pulse part of speech and noise for unvoiced part of speech. The voicing analysis is how much is pulse and how much is noise. The degree of voicing correlation is also used to do this. We do that by breaking the signal into frequency bands and in each frequency band we use the correlation at the pitch value in the frequency band as a measure of how voiced that frequency band is. The pitch period is determined for all possible lags or delays where the delay is determined by the pitch back by T samples. In the correlation one looks for the highest correlation value.

Correlation strength is a function of pitch lag. We search that function to find the best lag. For the lag we get a correlation strength which is a measure of the degree that the model fits.

When we get best lag or correlation we get the pitch and we also get correlation strength at that lag which is used for voicing.

For pitch we compute the correlation of the input against itself $$C(T) = \sum_{n=0}^{N-1} x_n x_{n-T}$$

In the prior art this correlation is on a whole frame basis to get the best predictable value or minimum prediction error on a frame basis. The error $$E = \sum_n (x_n - \hat{x}_n)^2$$

where the predicted value $\hat{x}_n = g x_{n-T}$ (some delayed version T) where g=a scale factor which is also referred to as pitch prediction coefficient $$E = \sum_n (x_n - g x_{n-T})^2$$

one tries to vary time delay T to find the optimum delay or lag.

It is assumed that in the prior art g and T are constant over the whole frame.

It is known that g and T are not constant over a whole frame.

SUMMARY OF THE INVENTION

In accordance with one embodiment of the present invention, a subframe-based correlation method for pitch and voicing is provided by finding the pitch track through a speech frame that minimizes the pitch-prediction residual energy over the frame assuming that the optimal pitch prediction coefficient will be used for each subframe lag.

DESCRIPTION OF PREFERRED EMBODIMENTS OF THE PRESENT INVENTION

In accordance with one embodiment of the present invention, there is provided a method for computing correlation that can account for changes in pitch within a frame by using subframe-based correlation to account for variations over a frame. The objective is to find the pitch track through a speech frame that minimizes the pitch prediction residual energy over the frame, assuming that the optimal pitch prediction coefficient will be used for each subframe lag $T_s$. Formally, this error can be written as a sum over $N_s$ subframes.

$$E = \sum_{s=1}^{N_s} E_s \left[ \sum_n x_n^2 - \frac{\left(\sum_n x_n x_{n-T_s}\right)^2}{\sum_n x_{n-T_s}^2} \right] \tag{1}$$

where $x_n$ is the $n^{th}$ sample of the input signal and the sum over n includes all the samples in subframe s. Minimizing the pitch prediction error or residual energy is equivalent to finding the set of subframe lags $\{T_s\}$ to maximize the correlation. The part after the minus term is what reduces the error or maximizes the correlation so we have for the maximum over the set of $$T_s\left(\overset{\max}{\{T_s\}}\right):$$

$$\max_{\{T_s\}}\left[\sum_{s=1}^{N_s}\frac{\left(\sum_n x_n x_{n-T_s}\right)^2}{\sum_n x_{n-T_s}^2}\right] \tag{2}$$

We find set of $\{T_s\}$ which is the maximum over the double sum. It is the maximum over the set of $T_s$ from s=1 to $N_s$ (all frame). According to the present invention, we also impose the constraint that each subframe pitch lag $T_s$ must be within a certain range or constraint Δ of an overall pitch value T:

$$T = \max_{T=lower}^{upper}\left[\sum_{s=1}^{N_s}\max_{T_s=T-\Delta}^{T+\Delta}\left[\frac{\left(\sum_n x_n x_{n-T_s}\right)^2}{\sum_n x_{n-T_s}^2}\right]\right] \tag{3}$$

We are therefore going to search for the maximum over all of possible pitch lags T (lower to upper max). The overall T we are finding is the maximum value. Note that without the pitch tracking constraint the overall prediction error is minimized by finding the optimal lag for each subframe independently. This method incorporates the energy variations from one subframe to the next.

Figure 1:
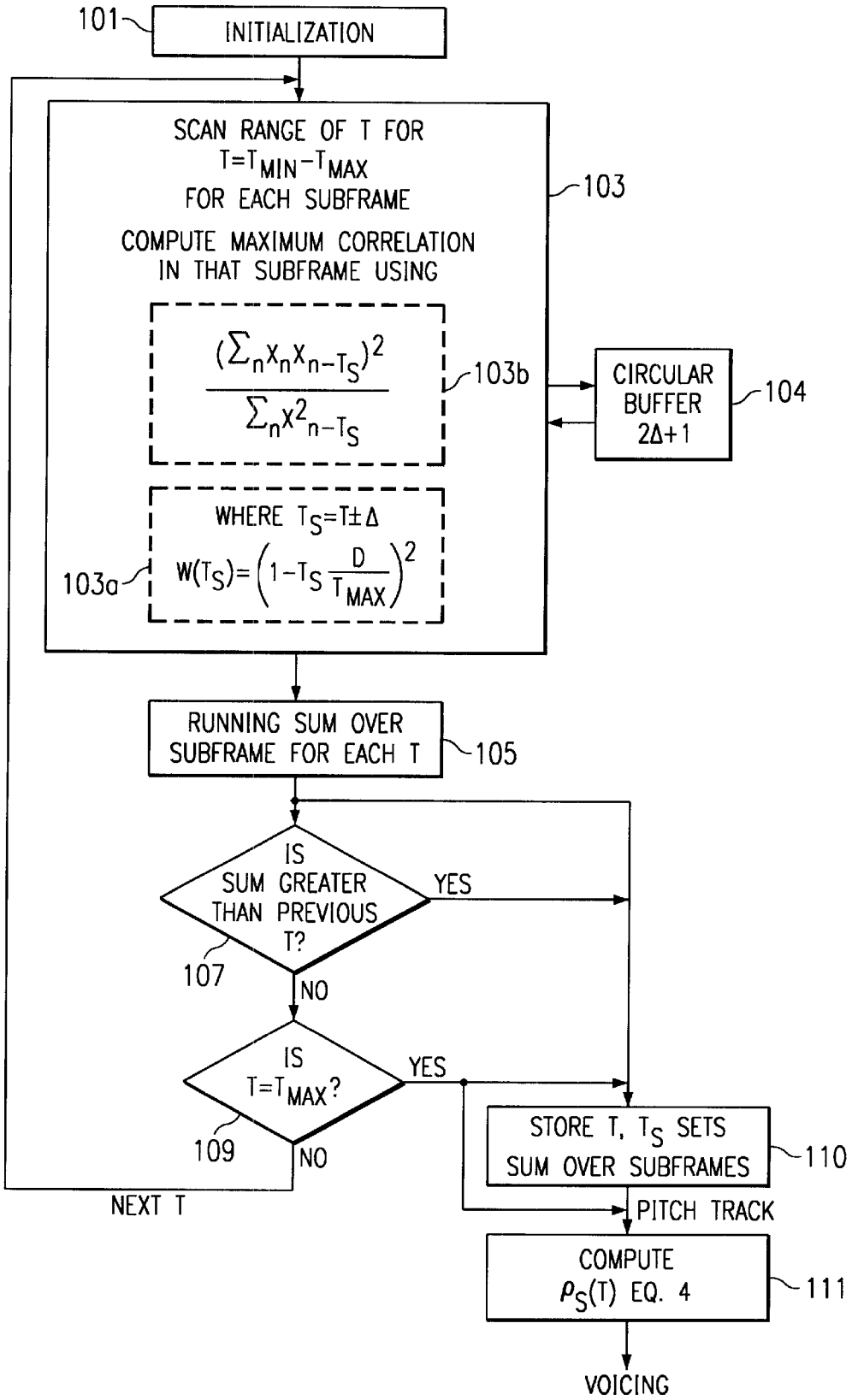
FIG. 1 is a flow chart of the basic subframe correlation method according to one embodiment of the present invention.

In accordance with the present invention as illustrated in FIG. 1, a subframe-based correlation method is achieved by a processor programmed according to the above equation (3).

After initialization of step 101, the program scans step 102 the whole range of T lags times from for example 20 to 160 samples.

For $T=T_{min}-T_{max}$(20 to 160 samples)

The program involves a double search. Given a T, the inner search is performed across subframe lags $\{T_s\}$ within (the constraint) Δ of that T. We also want the maximum correlation value over all possible values of T. The program in step 103 for each T computes the maximum correlation value of $$\frac{\left(\sum_n x_n x_{n-T_s}\right)^2}{\sum_n x_{n-T}^2}$$

for the subframe s where the search range for the subframe is 2Δ+1 lag values (for typical value of Δ=5, 11 lag values). We find the $T_s$ maximum value out of the 2Δ+1 lag values in a circular buffer 104. For example, if T=50 the subframe lag $T_s$ varies from 45–55 so we search the 11 values in each subframe. When T goes to 51 the range of $T_s$ is 46–56. All but one of these values was previously used so we use a circular buffer (104) and add the new correlation value for $T_s$=56 and remove the old one corresponding to $T_s$=45. Find the $T_s$ in these 11 that gives the maximum correlation value. This is done for all values of T (step 103). The program then looks for the best T overall by summing the correlation values of subframe sets $T_s$, comparing the sets of subframes and storing the sets that correspond to the maximum value and storing that T and sets of $T_s$ that correspond to the maximum value. This can be done by a running sum over the subframe for each lag T from $T_{min}\rightarrow T_{max}$ (step 105) and comparing the current sum with previous best running sum of subframes for other lags T (step 107). The greatest value represents the best correlation value and is stored (step 110).

This can be done by the program comparing the sum of the sets of frames with each previous set and selecting the greater. The program ends after reaching the maximum lag $T_{max}$ (step 109) and the best is stored. A c-code example to search for best pitch path follows where pcorr is the running sum, v_inner is a function product of two vectors $\Sigma_n x_n x_{n-T_s}$, temp*temp is squaring, v_magsq is $\Sigma_n x_{n-T_s}^2$, and maxloc is the location of the maximum in the circular buffer:

```
/*  Search for best pitch path */
    for (i = lower; i <= upper; i++) {
        pcorr = 0.0;
        /* Search pitch range over subframes */
        c_begin = sig_in;
        for (j = 0; j < num_sub; j++) {
            /* Add new correlation to circular buffer */
            /* use backward correlations */
            c_lag = c_begin-i-range;
            if (i+range > upper)
                /* don't go outside pitch range */
                corr[j][nextk[j]] = -FLT_MAX;
            else {
                temp = v_inner(c_begin,c_lag,sub_len[j]);
                if (temp > 0.0)
                    corr[j][nextk[j]] =
                        temp*temp/v_magsq(c_lag,sub_len[j]);
                else
                    corr[j][nextk[j]] = 0.0;
            }
            /* Find maximum of circular buffer */
            maxloc = 0;
            temp = corr[j][maxloc];
            for (k = 1; k < range2; k++) {
                if (corr[j][k] > temp) {
                    temp = corr[j][k];
                    maxloc = k;
                }
            }
            /* Save best subframe pitch lag */
            if (maxloc <= nextk[j])
                sub_p[j] = i + range + maxloc - nextk[j];
            else
                sub_p[j] = i + range + maxloc - range2 - nextk[j];
            /*  Update correlations with pitch doubling check */
                pdbl = 1.0 -
                (sub_p[j]*(1.0 - DOUBLE_VAL)/(upper));
                pcorr += temp*pdbl*pdbl;
            /* Increment circular buffer pointer and c_begin */
        nextk[j]++;
        if (nextk[j] >= range2)
            nextk[j] = 0;
        c_begin += sub_len[j];
    }
    /* check for new maxima with pitch doubling */
    if (pcorr > maxcorr) {
        /* New max: update correlation and pitch path */
        maxcorr = pcorr;
        v_equ_int(ipitch,sub_p,num_sub);
    }
}
```

For voicing we need to calculate the normalized correlation coefficient (correlation strength) ρ for the best pitch path found above.

For voicing we need to determine what is the normalized correlation coefficient. In this case, we need a value between −1 and +1. We use this as voicing strength. For this case we use the path of $T_s$ determined above and use the set of values $T_s$ in the equation to compute the normalized correlation $$\rho(T) = \sqrt{\frac{\sum_{s=1}^{N_s} \frac{\left(\sum_n x_n x_{n-T_s}\right)^2}{\sum_n x_{n-T_s}^2}}{\sum_{s=1}^{N_s} \sum_n x_n^2}} \tag{4}$$

We go back and recompute for the subframe $T_s$. We know we evaluate ρ only for the wining path $T_s$. We could either save these when computing subframe sets $T_s$ and then compute using the above formula 4 or recompute. See step 111 in FIG. 1.

An example of c-code for calculating normalized correlation for pitch path follows:

```
/* Calculate normalized correlation for pitch path */
    pcorr = 0.0;
    pnorm = 0.0;
    c_begin = sig_in;
    for (j = 0; j < num_sub; j++) {
        c_lag = c_begin-ipitch[j];
        temp = v_inner(c_begin,c_lag,sub_len[j]);
        if (temp > 0.0)
            temp = temp*temp/v_magsq(c_lag,sub_len[j]);
        else
            temp = 0.0;
        pcorr += temp;
        pnorm += v_magsq(c_begin,sub_len[j]);
        c_begin += sub_len[j];
    }
    pcorr = sqrt(pcorr/(pnorm+0.01));
    /* Return overall correlation strength */
    return(pcorr);
}
/*
```

The present invention includes extensions to the basic invention, including modifications to deal with pitch doubling, forward/backward prediction and fractional pitch.

Pitch doubling is a well-known problem where a pitch estimation returns a pitch value twice as large as the true pitch. This is caused by an inherent ambiguity in the correlation function that any signal that is periodic with period T has a correlation of 1 not just at lag T but also at any integer multiple of T so there is no unique maximum of the correlation function. To address this problem, we introduce a weighting function w(T) that penalizes longer pitch lags T.

In accordance with a preferred embodiment, the weighting is $$w(T_s) = \left(1 - T_s \frac{D}{T_{\max}}\right)^2$$

with a typical value for D of 0.1. The value D determines how strong the weighting is. The larger the D the larger the penalty. The best value is determined experimentally. This is done on a subframe basis. This weighting is represented by substep block 103*a* within 103. The overall value of the equation substep block 103*b* of block 103 is weighted by multiplying by $$\left(1 - T_s \frac{D}{T_{\max}}\right)^2.$$

This pitch doubling weighting is found in the bracketed portion of the code provided above and is done on the subframe basis in the inner loop.

The typical formulation of pitch prediction uses forward prediction where the prediction is of the current samples based on previous samples. This is an appropriate model for predictive encoding, but for pitch estimation it introduces an asymmetry to the importance of input samples used for the current frame, where the values at the start of the frame contribute more to the pitch estimation than samples at the end of the frame. This problem is addressed by combining both forward and backward prediction, where the backward prediction refers to prediction of the current samples from future ones. For the first half of the frame, we predict current samples from future values (backward prediction) while for the second half of the frame we predict current samples from past samples (forward prediction). This extends the total prediction error to the following:

$$E = \sum_{s=1}^{\frac{N_s}{2}} \left[ \sum_n x_n^2 - \frac{\left(\sum_n x_n x_{n+T_s}\right)^2}{\sum_n x_{n+T_s}^2} \right] + \sum_{s=\frac{N_s}{2}+1}^{N_s} \left[ \sum_n x_n^2 - \frac{\left(\sum_n x_n x_{n-T_s}\right)^2}{\sum_n x_{n-T_s}^2} \right] \tag{5}$$

Finding the subframe lag using equation 5 would be $$\max_{\{T_s\}} \left[ \sum_{s=1}^{\frac{N_s}{2}} \left[ \frac{\left(\sum_n x_n x_{n+T_s}\right)^2}{\sum_n x_{n+T_s}^2} \right] + \sum_{s=\frac{N_s}{2}+1}^{N_s} \left[ \frac{\left(\sum_n x_n x_{n-T_s}\right)^2}{\sum_n x_{n-T_s}^2} \right] \right]$$

Pacing the constraint of a the computing in step 103b would be for the overall $$\max_{lower}^{upper} \sum_{s=1}^{\frac{N_s}{2}} \max_{T-\Delta}^{T+\Delta} \left[ \frac{\left(\sum_n x_n x_{n+T_s}\right)^2}{\sum_n x_{n-T_s}^2} \right] + \sum_{s=\frac{N_s}{2}+1}^{N_s} \max_{T-\Delta}^{T+\Delta} \left[ \frac{\left(\sum_n x_n x_{n-T_s}\right)^2}{\sum_n x_{n-T_s}^2} \right] \tag{6}$$

This operation is illustrated by the following program:

```
/* Search for best pitch path */
for (i = lower; i <= upper; i++) {
    pcorr=0.0;
    /* Search pitch range over subframes */
    for (j = 0;j < num_sub;j++) {
        /* Add new correlation to circular buffer */
        c_begin = &sig_in[j*sub_len];
        /* check forward or backward correlations */
        if (j < num_sub2)
            c_lag = c_begin+i+range;
        else
            c_lag = c_begin-i-range;
        if (i+range > upper)
            /* don't go outside pitch range */
            corr[j][nextk[j]] = -FLT_MAX;
        else {
            temp = v_inner(c_begin,c_lag,sub_len);
            if (temp > 0.0)
                corr[j][nextk[j]] =
                    temp*temp/v_magsq(c_lag,sub_len);
            else
                corr[j][nextk[j]] = 0.0;
        }
        /* Find maximum of circular buffer */
        maxloc = 0;
        temp = corr[j][maxloc];
```

-continued

```
        for (k = 1; k < range2; k++) {
            if (corr[j][k] > temp) {
                temp = corr[j][k];
                maxloc = k;
            }
        }
        /* Save best subframe pitch lag */
        if (maxloc <= nextk[j])
            sub_p[j] = i + range + maxloc - nextk[j];
        else
            sub_p[j] = i + range + maxloc - range2 - nextk[j];
        /* Update correlations with pitch doubling check */
        /*   Update correlations with pitch doubling check */
            pdbl = 1.0 - (sub_p[j]*(1.0-DOUBLE_VAL)/(upper));
            pcorr + = temp*pdbl*pdbl;
        /* Increment circular buffer pointer */
        nextk[j]++;
        if (nextk[j] >= range2)
            nextk[j] = 0;
    }
    /* check for new maxima with pitch doubling */
    if (pcorr > maxcorr) {
            /* New max: update correlation and pitch path */
            maxcorr = pcorr;
            v_equ_int(ipitch,sub_p,num_sub);
    }
}
```

Another problem with traditional correlation measures is that they can only be computed for pitch lags that consist of an integer number of samples. However, for some signals this is not sufficient resolution, and a fractional value for the pitch is desired. For example, if the pitch is between 40 and 41, we need to find the fraction of a sampling period (q). We have previously shown that a linear interpolation formula can provide this correlation for a frame-based case. To incorporate this into the subframe pitch estimator, one can use the fractional pitch interpolation formula for the subframe estimate $\rho_s(T_s)$ instead of the integer pitch shown in Equation 3. This fractional pitch estimation can be derived from the equation in column 8 in U.S. Pat. No. 5,699,477 incorporated herein by reference where P is $T_s$ and c is the inner product of the two vectors $c(t_1, t_2)=\Sigma_n x_{n-t_1} x_{n-t_2}$. For example, $c(\mathbf{0},T+1)=\Sigma_n X_n x_{n-(T+1)}$. The fraction q of a sampling period to add to $T_s$ equals:

$$\frac{c(0, T_s+1)c(T_s, T_s) - c(0, T_s)c(T_s, T_s+1)}{c(0, T_s+1)[c(T_s, T_s) - c(T_s, T_s+1)] + c(0, T_s)[c(T_s+1, T_s+1) - c(T_s, T_s+1)]}$$

The normalized correlation uses the second formula on column 8 for each of the subframes we are using. For this equation P is $T_s$ and c is the inner product so:

$$\rho_s(T_s+q) = \frac{(1-q)c(0, T_s) + qc(0, T_{s+1})}{\sqrt{c(0, 0)[(1-q)^2(T_s, T_s) + 2q(1-q)c(T_s, T_{s+1}) + q^2 c(T_{s+1}, T_{s+1})]}} \tag{8}$$

Equation 4 gives the normalized correlation for whole integers. This becomes $$\rho(T) = \sqrt{\frac{\sum_{s=1}^{N_s} P_s \rho_s^2(T_s)}{\sum_{s=1}^{N_s} p_s}} \tag{9}$$

$$\text{where } P_s = \sum_n x_n^2 \text{ and } \rho_s(T_s) = \frac{\sum_n x_n x_{n-T_s}}{\sqrt{\sum_n x_n^2 \sum_n x_{n-T_s}^2}}$$

The values for $\rho_s(T_s+q)$ in equation 8 are substituted for $\rho_s(T_s)$in the equation 9 above to get the normalized correlation at the fractional pitch period.

An example of code for computing normalized correlation strengths using fractional pitch follows where temp is $\rho_s(T_s+q)$, $P_s$ is v_magsq(c_begin,length), pcorr is ρ(T) and co_T is c(0,T):

```
/*
    Subroutine sub_pcorr: subframe pitch correlations
*/
float sub_pcorr(float sig_in[],int pitch[],int num_sub,int length)
{
    int num_sub2 = num_sub/2;
    int j,forward;
    float *c_begin, *c_lag;
    float temp,pcorr;
/* Calculate normalized correlation for pitch path */
    pcorr = 0.0;
    for (j = 0; j < num_sub; j++) {
        c_begin = &sig_in[j*length];
        /* check forward or backward correlations */
        if (j < num_sub2)
            forward = 1;
        else
            forward = 0;
        if (forward)
            c_lag = c_begin+pitch[j];
        else
            c_lag = c_begin-pitch[j];
/* fractional pitch */
        frac_pch2(c_begin,&temp,pitch[j],PITCHMIN,PITCHMAX,length,forwar
d);
        if (temp > 0.0)
            temp = temp*temp*v_magsq(c_begin,length);
        else
            temp = 0.0;
```

-continued

```
        pcorr += temp;
    }
    pcorr = sqrt(pcorr/(v_magsq(&sig_in[0],num_sub*length)+0.01));
    return(pcorr);
}
/*                                                    */
/* frac_pch2.c: Determine fractional pitch.           */
/*                                                    */
#define MAXFRAC 2.0
#define MINFRAC -1.0
float frac_pch2(float sig_in[],float *pcorr, int ipitch, int pmin, int pmax,
int length, int forward)
{
    float c0_0,c0_T,c0_T1,cT_T,cT_T1,cT1_T1,c0_Tm1;
    float frac,frac1;
    float fpitch,denom;
    /* Estimate needed crosscorrelations *,
    if (ipitch >= pmax)
      ipitch = pmax - 1;
    if (forward) {
        c0_T = v_inner(&sig_in[0],&sig_in[ipitch],length);
        c0_T1 = v_inner(&sig_in[0],&sig_in[ipitch+1],length);
        c0_Tm1 = v_inner(&sig_in[0],&sig_in[ipitch-1],length);
    }
    else {
        c0_T = v_inner(&sig_in[0],&sig_in[-ipitch],length);
        c0_T1 = v_inner(&sig_in[0],&sig_in[-ipitch-1],length);
        c0_Tm1 = v_inner(&sig_in[0],&sig_in[-ipitch+1],length);
    }
    if (c0_Tm1 > c0_T1) {
        /* fractional component should be less than 1, so decrement pitch */
        c0_T1 = c0_T;
        c0_T = c0_Tm1;
        ipitch--;
    }
    c0_0 = v_inner(&sig_in[0],&sig_in[0],length);
    if (forward) {
        cT_T = v_inner(&sig_in[ipitch],&sig_in[ipitch],length);
        cT_T1 = v_inner(&sig_in[ipitch],&sig_in[ipitch+1],length);
        cT1_T1 = v_inner(&sig_in[ipitch+1],&sig_in[ipitch+1],length);
    }
    else {
        cT_T = v_inner(&sig_in[-ipitch],&sig_in[-ipitch],length);
        cT_T1 = v_inner(&sig_in [-ipitch],&sig_in[-ipitch-1],length);
        cT1_T1 = v_inner(&sig_in[-ipitch-1],&sig_in[-ipitch-1],length);
    }
    /* Find fractional component of pitch within integer range */
    denom = c0_T1*(cT_T - cT_T1) + c0_T*(cT1_T1 - cT_T1);
    if (fabs(denom) > 0.01)
      frac = (c0_T1*cT_T - c0_T*cT_T1)/denom;
    else
      frac = 0.5;
    if (frac > MAXFRAC)
      frac = MAXFRAC;
    if (frac < MINFRAC)
      frac = MINFRAC;
    /* Make sure pitch is still within range */
    fpitch = ipitch + frac;
    if (fpitch > pmax)
      fpitch = pmax;
    if (fpitch < pmin)
      fpitch = pmin;
    frac = fpitch - ipitch;
    /* Calculate interpolated correlation strength */
    frac1 = 1.0 - frac;
    denom = c0_0*(frac1*frac1*cT_T + 2*frac*frac1*cT_T1 + frac*frac*cT1_T1);
    denom = sqrt(denom);
    if (fabs(denom) > 0.01)
      *pcorr = (frac1*c0_T + frac*c0_T1)/denom;
    else
      *pcorr = 0.0;
    /* Return full floating point pitch value */
    return(fpitch);
}
#undef MAXFRAC
#undef MINFRAC
```

Figure 2:
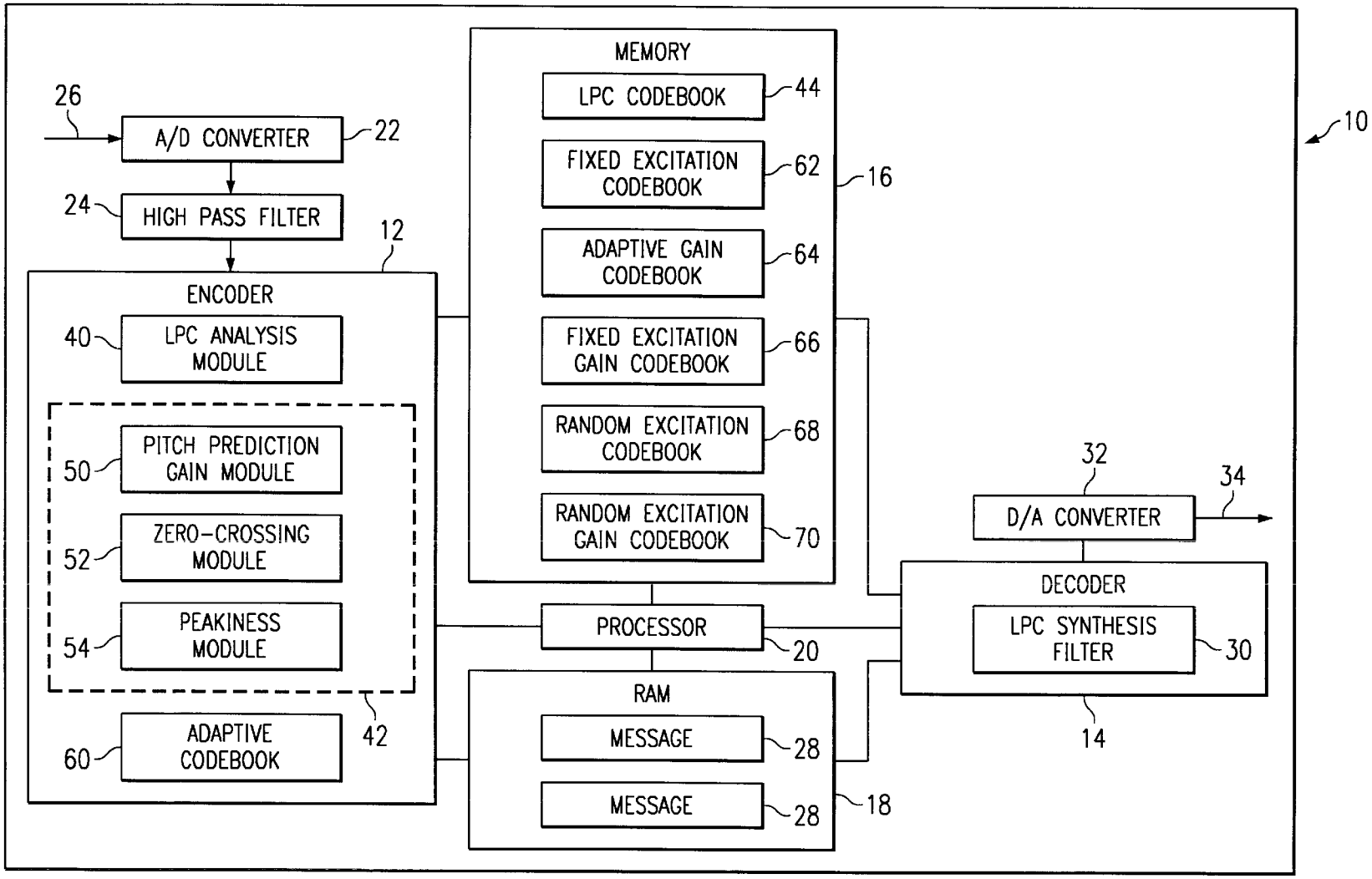
FIG. 2 is a block diagram of a multi-modal CELP coder.
Figure 3:
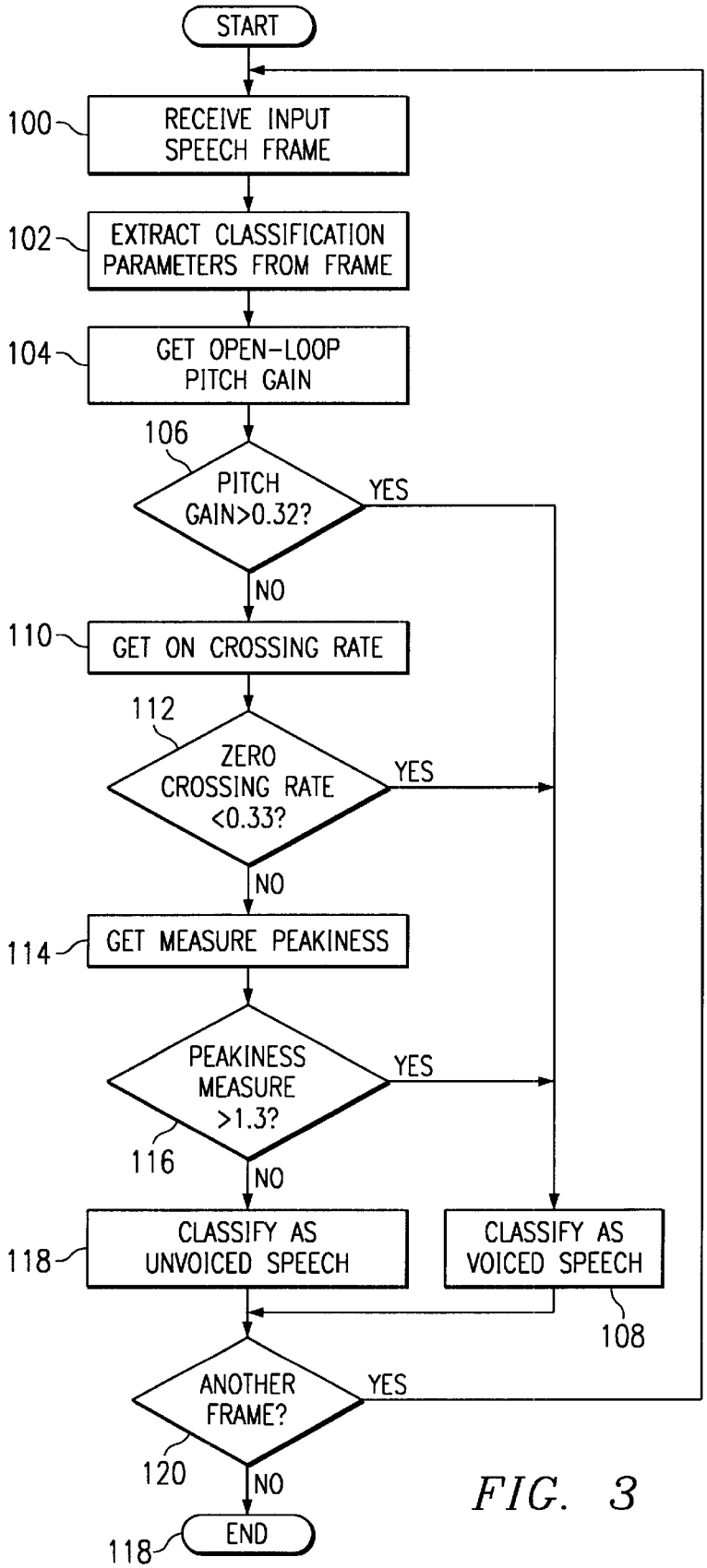
FIG. 3 is a flow diagram of a method characterizing voiced and unvoiced speech with the CELP coder of FIG. 2.
Figure 4:
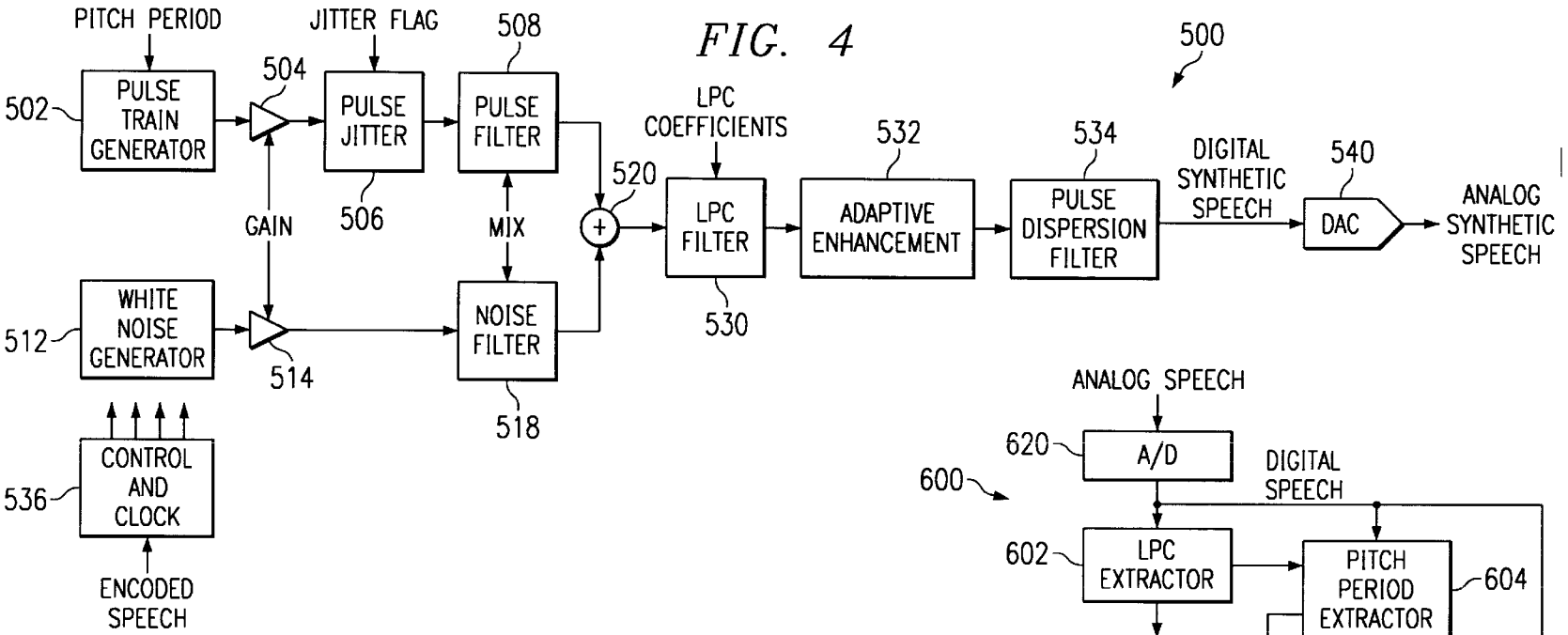
FIG. 4 is a block diagram of a MELP coder.

The subframe-based estimate herein has application to the multi-modal CELP coder as described in patent of Paksoy and McCree, U.S. Pat. No. 6,148,282, entitled "MULTIMODAL CODE-EXCITED LINEAR PREDICTION (CELP) CODER AND METHOD USING PEAKINESS MEASURE." This patent is incorporated herein by reference. A block diagram of this CELP coder is illustrated in FIG. 2. This subframe-based pitch estimate can be used as an estimate for initial (open-loop) pitch estimation gain for a subframe in place of a frame. This is step 104 in FIG. 2 of the cited patent and is presented as FIG. 3 herein. FIG. 3 illustrates a flow chart of a method of characterizing voiced and unvoiced speech in the CELP coder. In accordance with the present invention, one searches over the pitch range for the pitch lag T with maximum correlation as given above. The weighting function described above is used to penalize pitch doubles. For this example, only forward prediction and integer pitch estimates are used. This open loop pitch estimate constrains the pitch range for the later closed loop procedure. In addition, the normalized correlation p can be incorporated into a multi-modal CELP coder as a measure of voicing.

Figure 5:
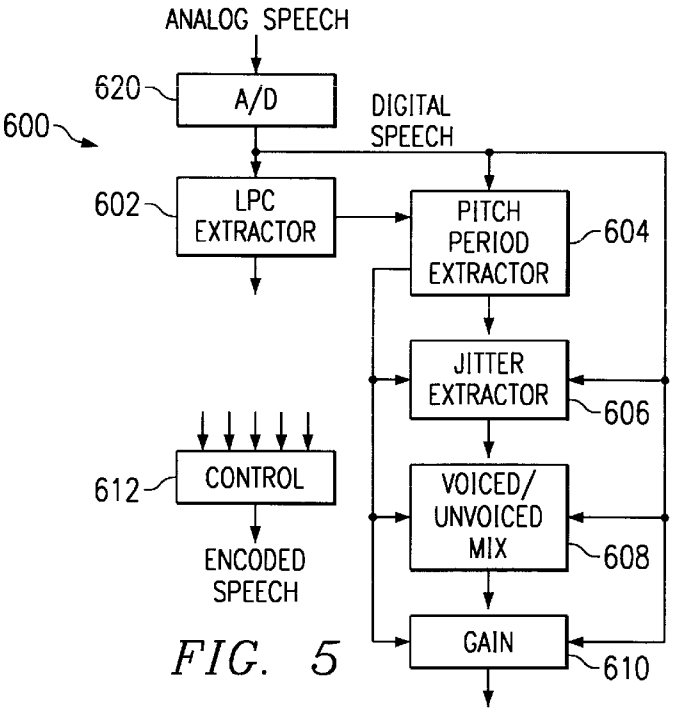
FIG. 5 is a block diagram of an analyzer used in the MELP coder of FIG. 4.

The Mixed Excitation Linear Predictive (MELP) coder was recently adopted as the new U.S. Federal Standard at 2.4 kb/s. Although 2.4 kb/s is illustrates a MELP synthesizer with mixed pulse and noise excitation, periodic pulses, adaptive spectral enhancement, and a pulse dispersion filter. This subframe based method is used for both pitch and voicing estimation. An MELP coder is described in applicants' U.S. Pat. No. 5,699,477 incorporated herein by reference. The pitch estimation is used for the pitch extractor 604 of the speech analyzer of FIG. 6 in the above-cited MELP patent. This is illustrated herein as FIG. 5. For pitch estimation the value of T is varied over the entire pitch range and the pitch value T is found for the maximum values (maximum set of subframes $T_s$). We also find the highest normalized correlation ρ of the low pass filtered signal, with the additional pitch doubling logic by the weighting function described above to penalize pitch doubles. The forward/backward prediction is used to maintain a centered window, but only for integer pitch lags.

For bandpass voicing analysis, we apply the subframe correlation method to estimate the correlation strength at the pitch lag for each frequency band of the input speech. The voiced/unvoiced mix determined herein with ρ is used for mix 608 of FIG. 6 of the cited application and FIG. 5 of the present application. One examines all of the frequency bands and computes a ρ for each. In this case, applicants use the forward/backward method with fractional itch interpolation but no weighting function is used since applicants use the estimated integer pitch lags from the pitch search rather than performing a search.

Experimentally, the subframe-based pitch and voicing performs better than the frame-based approach of the Federal Standard, particularly for speech transition and regions of erratic pitch.

What is claimed is:

1. A subframe-based correlation method comprising the steps of:

varying lag times T over all pitch range in a speech frame;

determining pitch lags for each subframe within said overall range that maximize the correlation value according to $$\frac{\sum_n (x_n x_{n-T_s})^2}{\sum_n x_{n-T}^2}$$

provided the pitch lags across the subframe are within a given constrained range, where $T_s$ is the subframe lag, $x_n$ is the $n^{th}$ sample of the input signal and the $\Sigma_n$ includes all samples in subframes.

2. The method of claim 1 wherein said constrained range is T-Δ to T+Δ where T is the lag time.

3. The method of claim 2 where Δ=5.

4. The method of claim 1 wherein the determining step further includes determining maximum correlation values of subframes $T_s$ for each value T, sum sets of $T_s$ over all pitch range and determine which set of $T_s$ provides the maximum correlation value over the range of T.

5. The method of claim 1 wherein for each subframe performing pitch there is a weighting function to penalize pitch doubles.

6. The method of claim 5 wherein the weighting function is $$w(T_s) = \left(1 - T_s \frac{D}{T_{\max}}\right)^2,$$

where D is a value between 0 and 1 depending on the weight penalty.

7. The method of claim 6 where D is 0.1.

8. The method of claim 4 wherein pitch prediction comprises of predictions from future values and past values.

9. The method of claim 4 wherein pitch prediction comprises for the first half of a frame predicting current samples from future values and for the second half of the frame predicting current samples from past samples.

10. A subframe-based correlation method comprising the steps of:

varying lag times T over all pitch range in a speech frame;

determining pitch lags for each subframe within said overall range that maximize the correlation value according to $$\frac{\sum_n (x_n x_{n-T_s})^2}{\sum_n x_{n-T}^2} \times w(T_s)$$

provided the pitch lags across the subframe are within a given constrained range, where $T_s$ is the subframe lag, $x_n$ is the $n^{th}$ sample of the input signal $w(T_s)$ is a weighting function to penalize pitch doubles and the $\Sigma_n$ includes all samples in subframes.

11. The method of claim 10 wherein said constrained range is T-Δ to T+Δ where T is the lag time.

12. The method of claim 11 where Δ=5.

13. The method of claim 10 wherein the determining step further includes determining maximum correlation values of subframes $T_s$ for each value $$\tilde{T},$$

sum sets of $T_s$ over all pitch range and determine which set of $T_s$ provides the maximum correlation value over the range of T.

14. The method of claim 10 wherein the weighting function is $$w(T_s) = \left(1 - T_s \frac{D}{T_{\max}}\right)^2$$

where D is between 0 and 1 depending on the determined weight penalty.

15. A method of determining normalized correlation coefficient comprising the steps of:

providing a set of subframe lags $T_s$ and computing the normalized correlation for that set of $T_s$ according to $$\rho(T) = \sqrt{\frac{\sum_{s=1}^{N_s} \frac{\left(\sum_n x_n x_{n-T_s}\right)^2}{\sum_n x_{n-T_s}^2}}{\sum_{s=1}^{N_s} \sum_n x_n^2}}$$

where $N_s$ is the number of samples in a frame and $x_n$ is the $n^{th}$ sample.

16. A subframe-based correlation method comprising the steps of:

varying lag times T over all pitch range in a speech frame;

determining pitch lags for each subframe within said overall range that maximize the correlation value according to $$\max_{\{T_s\}} \left[ \sum_{s=1}^{\frac{N_s}{2}} \left[ \frac{\left(\sum_n x_n x_{n+T_s}\right)^2}{\sum_n x_{n+T_s}^2} \times w(T_s) \right] + \sum_{s=\frac{N_s}{2}+1}^{N_s} \left[ \frac{\left(\sum_n x_n x_{n-T_s}\right)^2}{\sum_n x_{n-T_s}^2} \times w(T_s) \right] \right]$$

provided the pitch lags across the subframe are within a given constrained range, where $T_s$ is the subframe lag, $x_n$ is the $n^{th}$ sample of the input signal, $N_s$ is samples in a frame, $w(T_s)$ is a weighting function for doubles and the $\Sigma_n$ includes all samples in subframes.

17. The method of claim 16 wherein said constrained range is T-Δ to T+Δ where T is the lag time.

18. The method of claim 17 where Δ=5.

19. The method of claim 17 wherein the determining step further includes determining maximum correlation values of subframes $T_s$ for each value T, sum sets of $T_s$ over all pitch range and determine which set of $T_s$ provides the maximum correlation value over the range of T.

20. A voice coder comprising:

an encoder for voice input signals, said encoder including a pitch estimator for determining pitch of said input signals;

a synthesizer coupled to said encoder and responsive to said input signals for providing synthesized voice output signals, said synthesizer coupled to said pitch estimator for providing synthesized output based for said determined pitch of said input signals;

said pitch estimator determining pitch according to:

$$T = \max_{T=lower}^{upper} \left[ \sum_{s=1}^{N_s} \max_{T_s=T-\Delta}^{T+\Delta} \left[ \frac{\left(\sum_n x_n x_{n-T_s}\right)^2}{\sum_n x_{n-T}^2} \right] \right]$$

where $T_s$ is the subframe lag, $x_n$ is the $n^{th}$ sample of the input signal, $\rho_n$, includes all samples in the subframe, T is determining maximum correlation values of subframes for each value T, $N_s$ is the number of samples in a frame and Δ is the constrained range of the subframe.

21. A voice coder comprising:

an encoder for voice input signals, said encoder including means for determining sets of subframe lags $T_s$ over a pitch range; and means for determining a normalized correlation coefficient ρ(T) for a pitch path in each frequency band where ρ(T) is determined by $$\rho(T) = \sqrt{\frac{\sum_{s=1}^{N_s} \frac{\left(\sum_n x_n x_{n-T_s}\right)^2}{\sum_n x_{n-T_s}^2}}{\sum_{s=1}^{N_s} \sum_n x_n^s}}$$

where $N_s$ is the number of samples in a frame, and $x_n$ is the $n^{th}$ sample.

22. The voice coder of claim 21 including means responsive to said normalized correlation coefficient for controlling for voicing decision.

23. The voice coder of claim 21 including means responsive to said normalized correlation coefficient for controlling the modes in a multi-modal coder.

24. A voice coder comprising:

an encoder for voice input signals said encoder including a pitch estimator for determining pitch of said input signals;

a synthesizer coupled to said encoder and responsive to said input signals for providing synthesized voice output signals, said synthesizer coupled to said pitch estimator for providing synthesized output based for said determined pitch of said input signals;

said pitch estimator determining pitch according to:

$$T = \left[ \frac{\left(\sum_n x_n x_{n-T_s}\right)^2}{\sum_n x_{n-T}^2} \right]$$

where $T_s$ is the subframe lag, $x_n$ is the $n^{th}$ sample of the input signal and $\Sigma_n$ includes all samples in subframes.

25. A method of determining normalized correlation coefficient at fractional pitch period comprising the steps of:

providing a set of subframe lags $T_s$;

finding a fraction q by $$\frac{c(0, T_s+1)c(T_s, T_s) - c(0, T_s)c(T_s, T_s+1)}{c(0, T_s+1)[c(T_s, T_s) - c(T_s, T_s+1)] + c(0, T_s)[c(T_s+1, T_s+1) - c(T_s, T_s+1)]}$$

where c is the inner product of two vectors and the normalized correlation for subframe is determined by;

$$\rho_s(T_s+q) = \frac{(1-q)c(0, T_s) + qc(0, T_{s+1})}{\sqrt{c(0, 0)[(1-q)^2(T_s, T_s) + 2q(1-q)c(T_s, T_{s+1}) + q^2c(T_{s+1}, T_{s+1})]}};$$

and substituting $\rho_s(T_s+q)$ for $\rho_s$ in $$\rho(T) = \sqrt{\frac{\sum_{s=1}^{N_s} p_s\rho_s^2(T_s)}{\sum_{s=1}^{N_s} p_s}} \quad \text{where } p_s = \sum_n x_n^2.$$

* * * * *